US008002281B2

(12) United States Patent
Kearns, Sr.

(10) Patent No.: US 8,002,281 B2
(45) Date of Patent: Aug. 23, 2011

(54) METHODS AND DEVICES FOR PLAYING A MODIFIED BACCARAT GAME

(75) Inventor: Patrick Abbott Kearns, Sr., Las Vegas, NV (US)

(73) Assignee: NP IP Holdings LLC, Las Vegas, NV (US)

( * ) Notice: Subject to any disclaimer, the term of this patent is extended or adjusted under 35 U.S.C. 154(b) by 209 days.

(21) Appl. No.: 11/820,686

(22) Filed: Jun. 20, 2007

(65) Prior Publication Data

US 2008/0315522 A1 Dec. 25, 2008

(51) Int. Cl.
*A63F 1/00* (2006.01)

(52) U.S. Cl. ..... 273/292

(58) Field of Classification Search ..... None
See application file for complete search history.

(56) References Cited

U.S. PATENT DOCUMENTS

| | | | | |
|---|---|---|---|---|
| 5,362,064 | A * | 11/1994 | Lofink et al. | 273/292 |
| 5,395,119 | A | 3/1995 | Jacob et al. | |
| 5,423,551 | A | 6/1995 | Stavinsky | |
| 5,529,309 | A | 6/1996 | Bartlett | |
| 5,743,800 | A | 4/1998 | Huard et al. | |
| 5,806,854 | A | 9/1998 | Coleman et al. | |
| 5,857,678 | A | 1/1999 | Coleman et al. | |
| 5,876,283 | A * | 3/1999 | Parra et al. | 463/12 |
| 5,979,896 | A | 11/1999 | Lofink et al. | |
| 6,095,921 | A | 8/2000 | Walker et al. | |
| 6,099,408 | A | 8/2000 | Schneier et al. | |
| 6,139,430 | A | 10/2000 | Huard et al. | |

(Continued)

FOREIGN PATENT DOCUMENTS

WO WO 02/18023 3/2002

OTHER PUBLICATIONS

Singapore Search Report, Nov. 26, 2008.

(Continued)

*Primary Examiner* — Alvin A Hunter
*Assistant Examiner* — Dolores Collins
(74) *Attorney, Agent, or Firm* — Milbank, Tweed, Hadley & McCloy LLP

(57) ABSTRACT

Aspects of the present inventions concerns methods and devices for playing a game with predetermined rules using at least one standard deck of 52 actual or virtual playing cards, wherein at least two but no more than three cards are dealt to a first hand, at least two but no more than three cards are dealt to a second hand, and a player wagers on either (i) the first hand having a score closer or equal to a predetermined high value than the second hand, (ii) the second hand having a score closer or equal to the predetermined high value than the first hand, or (iii) the first and second hands having the same score, wherein the predetermined rules make the odds of the first hand having a score closer or equal to the predetermined high value more likely than the second hand having a score closer or equal to the predetermined high value. Such aspects include permitting a player to place an ante bet with a wager on the first hand having a score closer or equal to the predetermined high value than the second hand, collecting the ante bet from the player if the score of the first hand does not equal the score of the second hand, and paying the player an ante bet payoff if the score of the first hand equals the score of the second hand.

10 Claims, 2 Drawing Sheets

U.S. PATENT DOCUMENTS

| | | | | |
|---|---|---|---|---|
| 6,146,270 | A | 11/2000 | Huard et al. | |
| 6,164,651 | A | 12/2000 | Webb | |
| 6,224,055 | B1 | 5/2001 | Walker et al. | |
| 6,237,917 | B1 * | 5/2001 | Timpano | 273/292 |
| 6,241,250 | B1 | 6/2001 | Webb | |
| 6,250,685 | B1 | 6/2001 | Walker et al. | |
| 6,264,557 | B1 | 7/2001 | Schneier et al. | |
| 6,279,910 | B1 | 8/2001 | De Keller | |
| 6,293,866 | B1 | 9/2001 | Walker et al. | |
| 6,328,306 | B1 | 12/2001 | Webb | |
| 6,450,885 | B2 | 9/2002 | Schneier et al. | |
| 6,467,771 | B1 | 10/2002 | De Keller | |
| 6,488,284 | B2 | 12/2002 | Webb | |
| 6,572,107 | B1 | 6/2003 | Walker et al. | |
| 6,575,464 | B1 | 6/2003 | Fertitta et al. | |
| 6,579,178 | B1 | 6/2003 | Walker et al. | |
| 6,719,291 | B1 | 4/2004 | De Keller | |
| 6,742,781 | B1 | 6/2004 | Bartlett | |
| 6,789,801 | B2 | 9/2004 | Snow | |
| 6,811,153 | B1 | 11/2004 | Ko | |
| 6,837,494 | B2 | 1/2005 | Lee | |
| 6,871,855 | B1 | 3/2005 | Ko | |
| 6,896,614 | B2 | 5/2005 | Romero | |
| 6,929,264 | B2 | 8/2005 | Huard et al. | |
| 6,991,544 | B2 | 1/2006 | Soltys et al. | |
| 7,264,241 | B2 * | 9/2007 | Schubert et al. | 273/149 R |
| 7,311,603 | B2 | 12/2007 | Walker et al. | |
| 7,416,186 | B2 | 8/2008 | Walker et al. | |
| 2001/0035609 | A1 | 11/2001 | Webb | |
| 2003/0034608 | A1 | 2/2003 | Bui et al. | |
| 2004/0256803 | A1 | 12/2004 | Ko | |
| 2005/0073102 | A1 | 4/2005 | Yoseloff et al. | |
| 2005/0121852 | A1 | 6/2005 | Soltys et al. | |
| 2005/0137005 | A1 | 6/2005 | Soltys et al. | |
| 2005/0164759 | A1 | 7/2005 | Smith et al. | |
| 2006/0121975 | A1 | 6/2006 | Soltys et al. | |
| 2006/0178181 | A1 | 8/2006 | Chun | |
| 2006/0226605 | A1 | 10/2006 | Kenny | |
| 2007/0032283 | A1 | 2/2007 | Chun | |
| 2008/0012221 | A1 | 1/2008 | Webb | |

OTHER PUBLICATIONS

Australian Examiner's First Report in Application No. 2008202639, Feb. 4, 2010.

WO 2000/044454 (De Keller), Aug. 3, 2000.

Press Release, Mar. 17, 2006, Talisman Group to Distribute DEQ's No-Commission Baccarat Game Patents, 2 pages.

www.ezbaccarat.com, 2004, 13 pages.

* cited by examiner

METHODS AND DEVICES FOR PLAYING A MODIFIED BACCARAT GAME

FIELD OF THE INVENTION

The present invention relates to a modified version of Baccarat, and in particular, to a version of Baccarat where each player has the option to place an ante bet when betting on the Banker hand, thereby eliminating the need for payment and collection of a commission.

BACKGROUND OF THE INVENTION

Baccarat is a well-known card game typically played in a gambling establishment, such as a casino. Baccarat attracts casino-goers around the world who want to leverage their skill in a game that also depends largely on chance. Baccarat is popular with players because, among other things, it offers a low house edge. Players enjoy games with a low house edge because the lower the house edge, the more likely a player is to win. This is good for casinos, too, because a player's money may last longer and the player may spend more time in the casino and possibly explore other games with a higher house edge.

Baccarat is a card game typically played with multiple decks of standard 52-card decks. The cards may be shuffled, cut by a player (and such cut then marked with a "Cut" card), and placed in a "shoe" from which cards are dealt during play. As opposed to Poker or Black Jack, where each player is dealt an individual hand, typically only two "community" hands are dealt in Baccarat—a "Banker" hand and a "Player" hand. A "Caller," usually a casino employee, facilitates the game and deals the Banker and Player hands. The Banker hand and Player hand are played against each other, and each player places one of three principal bets: (1) Player hand wins; (2) Banker hand wins; or (3) Tie hand.

Baccarat is typically played on an oval table in a casino and can be found among other gaming tables or in a "high roller" section of a casino. Usually each seat is numbered, and tables may have room for up to 16 or even 24 players. In front of each seat on the Baccarat table are three spots to place bets: "Player," "Banker," or "Tie." Some Baccarat tables have small circles on the table to help guide players to place bets appropriately.

A Baccarat table typically also has a spot for a commission at each player's location. A commission is a percentage paid by the player to the house on each winning bet made on the Banker hand. In Baccarat, a 5% commission is typically charged. For example, if a player makes a $100 bet on the Banker hand, and the Banker hand wins, the player wins $100 but owes a $5 commission to the house. A dealer may then place $5 in chips in the player's commission spot to keep track of the commission owed.

The rules of conventional Baccarat are known to a person skilled in the art. In the United States, Baccarat is played generally as follows. Each player places a bet on whether (1) Banker hand wins; (2) Player hand wins; or (3) Tie hand. After all bets are made, the Caller deals one card to the Banker hand and one card to the Player hand, until each hand has a total of two cards. The cards may be dealt face up or face down, and are dealt to a Banker position and Player position designated on the Baccarat table. If the cards were dealt face down, the cards are turned over, and the dealer totals the score of the Banker and Player hands by adding the value of the cards in each hand. Scoring in Baccarat is in modulo ten. For example, if a player has a total of 16, his Baccarat point total would be 6. A player with an Ace and a Nine would have a zero score because an Ace is worth 1, and added to 9 is 10, which is zero in modulo ten. Therefore, nine is the highest point total in Baccarat. The hand with the higher point total wins.

A player typically receives even money if the player bets on the winning hand. For example, if a player bets $100 on the Player hand and the Player hand wins, the player will be paid $100. The same is true for a winning bet on the Banker hand, but the player must also pay a commission to the house. In a casino that charges 5% commission, for example, the player would owe $5 in commission based on his $100 winnings. A casino may charge a higher commission rate, but fewer players may choose to participate in a Baccarat game where higher commissions are assessed. No commission is paid on a winning bet on the Player hand—commission is only charged on a winning bet on the Banker hand.

If the score of the Player hand equals the score of the Banker hand, a Tie hand occurs. In a Tie hand, all bets on the Banker hand and the Player hand are "pushes," and the amount wagered is returned to each player. Winning bets on the Tie hand are typically paid at odds of nine-to-one or eight-to-one, depending on the casino or operator. A player is not charged commission on a winning bet on a Tie hand.

If either the Player or the Banker hand has a total of 8 or 9 on the initial deal, no further cards are drawn. If neither player has an 8 or a 9, a third card may be drawn depending on predetermined rules of the game. If the total of the Player hand is between 0 and 5, a third card is dealt to the Player hand. If the total of the Player hand is 6 or 7, the Player hand stands (i.e., does not draw a third card). Depending on whether the Player hand draws a card, and also depending on the particular card drawn, the Banker hand will automatically draw a third card according to predetermined rules. For example, if the Player hand draws a 2 or 3, the Banker hand draws a third card if the point total is between 0 and 4, and stands if the point total is between 5-7. The chart below shows an example of predetermined rules used in a Baccarat game:

TABLE 1

If either the Player or the Banker has a total of 8 or 9 on the initial deal, no further cards are drawn. If neither player has an 8 or a 9, play proceeds as follows:

| Player Hand | Banker Hand |
|---|---|
| Player hand stands if Player hand has a point total of 6-7. | Banker hand stands if Banker hand has a point total of 6-7. |
| If the Player hand has an initial total of 0-5, Player hand draws a single card. | Banker hand draws if Banker hand has a point total of 0-5. |
| If the Player hand draws a 4 or 5: | Banker hand draws if Banker hand total is 0-5, and stands if total is 6-7. |
| If the Player hand draws a 6 or 7: | Banker hand draws if Banker hand total is 0-6, and stands if total is 7. |
| If the Player hand draws an 8: | Banker hand draws if Banker hand total is 0-2, and stands if total is 3-7. |
| If the Player hand draws a 2 or 3: | Banker hand draws if Banker hand total is 0-4, and stands if total is 5-7. |
| If the Player hand draws an ace, 9, 10, or face-card: | Banker hand draws if Banker hand total is 0-3, and stands if total is 4-7. |

Because of the predetermined draw rules, the Banker hand has a slightly higher chance of winning than the Player hand. The winning frequency for the Banker hand has been determined to be 45.859% whereas the winning frequency for the Player hand is 44.624%, with a Tie hand occurring 9.517% of the time.

At the end of each hand, winning bets are paid and losing bets are collected by the house. A commission due to the house may be designated in a commission spot at a player's location at the table after each hand. The dealer may place the value of the commission in casino chips by each player, and commission may accrue until the end of the round. A round ends when all the cards—down to the Cut card—are dealt.

The commission may be collected at the end of the round so that the flow of the game is not interrupted. If a player has run out of chips, he may still owe a commission to the house. Casinos may find it difficult to collect commission owed from a player who has already lost all of his casino chips and cannot cover the commission charge.

It may be beneficial to have a new method and device for playing Baccarat where the commission described above is not required. It also may be beneficial to have a new method of playing Baccarat where a player is able to make an additional wager in lieu of paying a commission. It further may be beneficial to have a new method of playing Baccarat that eliminates collecting commissions and increases player participation by allowing players to play in a single currency.

SUMMARY OF THE INVENTION

One aspect of the present invention relates to a method of playing a game with predetermined rules using at least one standard deck of 52 actual or virtual playing cards, wherein at least two but no more than three cards are dealt to a first hand, at least two but no more than three cards are dealt to a second hand, and a player wagers on either (i) the first hand having a score closer or equal to a predetermined high value than the second hand, (ii) the second hand having a score closer or equal to the predetermined high value than the first hand, or (iii) the first and second hands having the same score, wherein the predetermined rules make the odds of the first hand having a score closer or equal to the predetermined high value more likely than the second hand having a score closer or equal to the predetermined high value. In such an aspect, the method includes permitting a player to place an ante bet with a wager on the first hand having a score closer or equal to the predetermined high value than the second hand, collecting the ante bet from the player if the score of the first hand does not equal the score of the second hand, and paying the player an ante bet payoff if the score of the first hand equals the score of the second hand.

In an embodiment, the ante bet payoff may be a multiple of the ante bet. In another embodiment, the ante bet payoff may be calculated from a flexible pay table. The pay table may vary based on a desired house advantage.

In another embodiment, a minimum value of the ante bet may be based on a frequency with which the score of the first hand exceeds the score of the second hand. In yet another embodiment, a minimum value of the ante bet may be determined by a casino or game operator.

In a further embodiment, a game operator may alternatively allow a player to be a commission player. The commission player may pay a commission when the commission player places a wager on the first hand and the score of the first hand is greater than the score of the second hand. The commission in this embodiment may be either 5% of the wager on the Banker hand or 5% of the payoff of the wager on the Banker hand.

In yet another embodiment, the ante bet may be at least 5% of the wager on the first hand and the ante bet payoff may be at a rate of 9-for-2 odds. In yet a further embodiment, a player who only places a wager on the Tie hand may be paid at a rate of 10-for-1 odds if the score of the second hand equals the score of the first hand.

In a variation of the above embodiment, the ante bet may be at least 10% of the wager on the first hand and the ante bet payoff may be at a rate of 8-for-1 odds.

Another aspect of the present invention relates to a device for playing a game with predetermined rules, such as a variant of Baccarat, that includes a display, a player input interface with a principal bet selector and an ante bet selector, and a computer processor in communication with the display and the player input interface. In such an aspect, the processor may be configured to (i) store data representing at least one standard deck of virtual playing cards and deal at least two but no more than three cards to a first hand, and at least two but no more than three cards to a second hand, (ii) permit a player to place a principal wager on either (a) the first hand having a score closer or equal to a predetermined high value than the second hand, (b) the second hand having a score closer or equal to the predetermined high value than the first hand, or (c) the first and second hands having the same score, (iii) permit a player to place an ante bet with a wager on the first hand having a score closer or equal to the predetermined high value than the second hand, (iv) collect the ante bet from the player if the score of the first hand does not equal the score of the second hand, and (v) pay the player an ante bet payoff if the score of the first hand equals the score of the second hand.

In one embodiment, the computer processor may be further configured to allow a player to select an option to be a commission player and to collect a commission from each commission player when the commission player places a wager on the first hand and the score of the first hand is greater than the score of the second hand. In another embodiment, the computer processor may be configured to calculate the ante bet payoff as a multiple of the ante bet or from a flexible pay table.

In yet another embodiment, the ante bet may be at least 5% of the wager on the first hand and the ante bet payoff may be at a rate of 9-for-2 odds. In a further embodiment, the computer processor may be configured to pay the player at a rate of 10-for-1 odds for a wager that the first and second hands will have the same score if the score of the second hand equals the score of the first hand.

In a variation of the above embodiment, the ante bet may be at least 10% of the wager on the first hand and the ante bet payoff may be at a rate of 8-for-1 odds. In a further embodiment, the computer processor may be configured to pay the player at a rate of 10-for-1 odds for a wager that the first and second hands will have the same score if the score of the second hand equals the score of the first hand.

BRIEF DESCRIPTION OF THE DRAWINGS

Features and other aspects of embodiments of the present invention are explained in the following description taken in conjunction with the accompanying drawings, wherein.

The drawings are exemplary, not limiting.

DETAILED DESCRIPTION OF PREFERRED EMBODIMENTS

Various embodiments of the present invention will now be described in greater detail with reference to the drawings.

Figure 1:
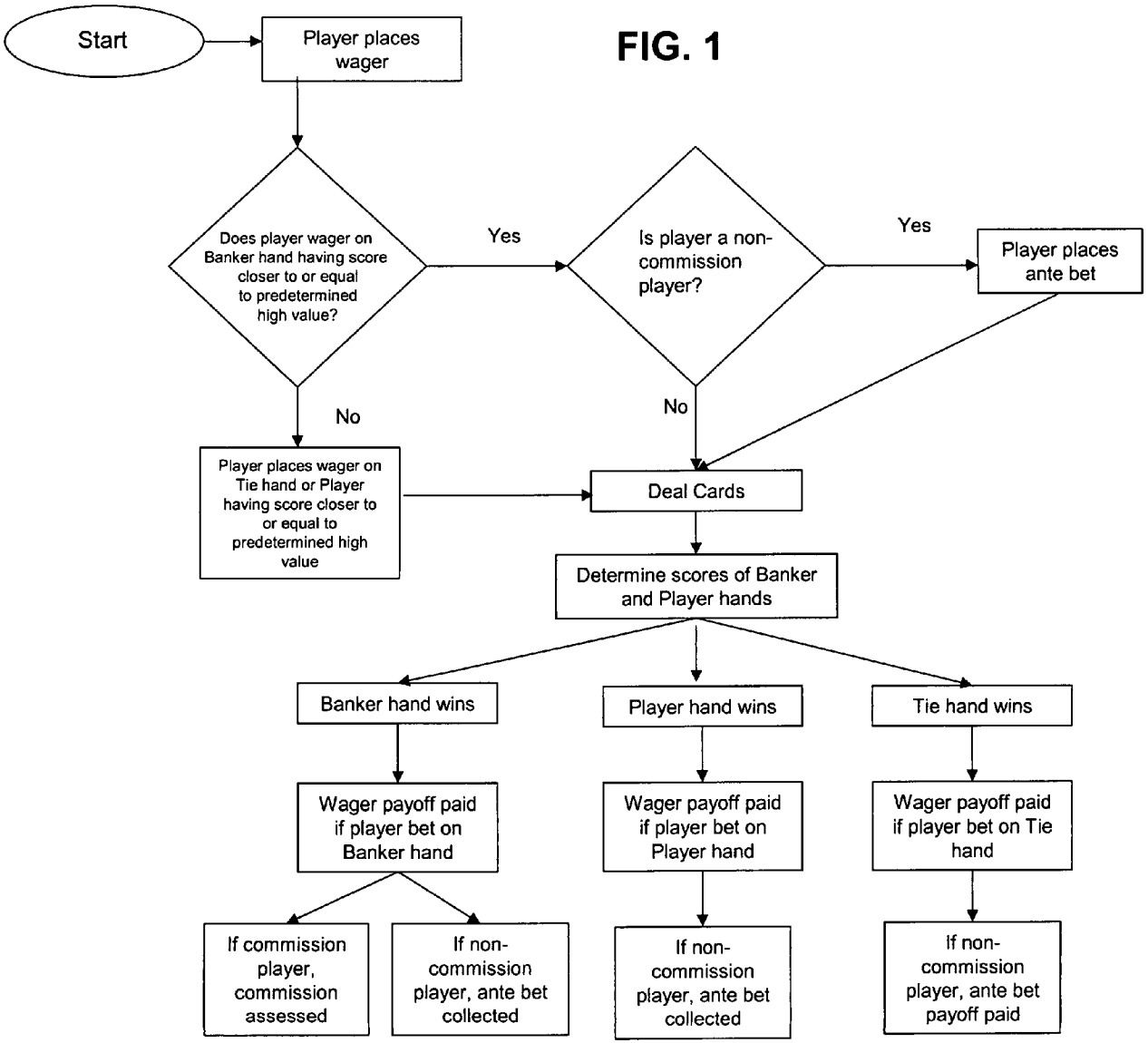
FIG. 1 illustrates a method of playing a game according to one or more embodiments of the present invention.

As shown in FIG. 1, one embodiment of the present invention includes a method of playing a game, which is a modified form of Baccarat, in which each player can make one of three principal bets: (1) Player hand wins; (2) Banker hand wins; or (3) Tie hand. Additional bets may be made during the play of the game depending on the predetermined rules of the game set by the game operator. Players may sit at a Baccarat table according to traditional Baccarat play. The table may be staffed by a Caller who directs the play of the game, and may also be staffed by at least one dealer who collects and pays bets as well as tallies any commissions due.

In one embodiment, each player may be permitted to play as either a commission or non-commission player. A non-commission player makes an ante bet if the non-commission player wagers on the Banker hand. In such an embodiment, another player may have the option of paying a commission in lieu of placing an ante bet. In that embodiment, the player can decide at the beginning of the round to be a commission or a non-commission player.

After each player makes his bet, along with any ante bet, two cards are dealt to the Player hand and to the Banker hand. The cards may be dealt in alternating fashion to each hand and may be placed face up or face down. If the cards are dealt face down, the Player and Banker hands are then turned over by the Caller. The Caller scores each hand using a modulo ten system according to conventional Baccarat rules. The hand with the highest score wins.

If the Player hand wins, each player that bet on the Player hand may be paid for his winning bet, typically at a 1-to-1 payoff rate. The bets placed on the Banker hand or Tie hand are collected, along with all ante bets placed by non-commission players. If the Banker hand wins, each player that bet on the Banker hand may be paid for his winning bet, typically at a 1-to-1 payoff rate. Also, any commission player may be assessed a commission on his winning bet. The commission may be 5% of the wager payoff, but the commission rate may vary depending on the game operator's desired house earnings. Wagers placed on the Player or Tie hands may be collected by a dealer, who is located near the Caller.

In one embodiment, as is the case in conventional Baccarat, if the Banker hand equals the Player hand, then a Tie hand wins. In the case of a Tie hand, in an embodiment of the present invention, the ante bet may be treated similar to a bet on a Tie hand under the traditional rules of Baccarat. According to this embodiment, the non-commission player may be paid an ante bet payoff based on the ante bet. In the case of a Tie hand, each wager on the Player or Banker hand is collected.

In one embodiment, the ante bet payoff may be a multiple of the ante bet, or it may be based on a flexible pay table. A flexible pay table may give players higher payoffs than are currently the norm in the gaming industry.

The ante bet may be placed on a spot on the table that, in traditional Baccarat play, is designated for commissions. Otherwise, the ante bet may be placed, for example, next to or near the player's wager on the Banker hand. A minimum value of the ante bet may be determined by the casino or game operator. The minimum ante bet value may vary in amount based on the operator's desired house advantage. A higher minimum ante bet generally may yield a greater house advantage. But it is understood that as the house raises the minimum ante bet, fewer players may choose to participate.

In one embodiment, the ante bet may be made using casino chips. In alternative embodiments, the ante bet may be made using another currency (e.g., cash). The use of consistent currency, such as casino chips, may streamline the game and enhances the player's experience.

In another embodiment, each player is a non-commission player. In other words, when placing a bet on the Banker hand, each player is required to also place an ante bet. Requiring a player to place an ante bet, in lieu of a commission, may eliminate an operator's cost of pursuing certain commissions from certain players. Instead, each player places the ante bet at the start of the hand if the player wagers on the Banker hand. If the player does not have enough chips for the ante bet, then the player simply cannot wager on the Banker hand.

In one embodiment, when a player decides to place a wager on the Banker hand, the player may be required to place an ante bet that may be at least 5% of the wager on the Banker hand. In this embodiment, the ante bet payoff may be paid at a rate of 9-for-2 odds if the Tie hand wins. In this embodiment, a player who only places a wager on the Tie hand may be paid at a rate of 10-for-1 odds if the Tie hand wins.

In another embodiment, players may be required to place an ante bet that may be at least 10% of the wager on the Banker hand. In such an embodiment, the ante bet payoff may be paid at a rate of 8-for-1 odds if the Tie hand wins. In this embodiment, a player who only places a wager on the Tie hand may be also paid at a rate of 10-for-1 odds if the Tie hand wins.

In certain embodiments described herein, the game may be a live game played with actual cards at an actual table with an actual dealer in a casino. But certain other embodiments described herein may not be limited to play at a physical gaming table with actual cards. Such embodiments may be played online or incorporated into an electronic gaming machine or automated gaming system. For example, the game of one embodiment may be played at a video monitor that displays virtual cards and some or all of a virtual table.

Figure 2:
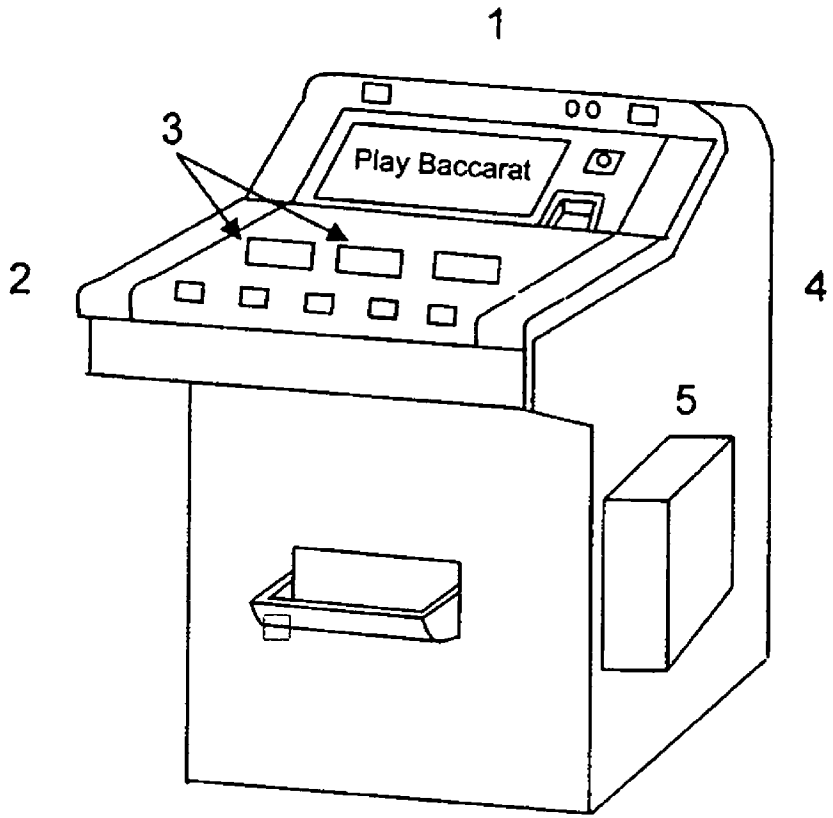
FIG. 2 shows a device for playing a game according to one or more embodiments of the present invention.

As shown in FIG. 2, another embodiment of the present invention may include a device for performing methods of playing games as described in embodiments herein, e.g., playing a modified form of Baccarat. The device 4 may include a display 1 and a player input interface 2 that includes at least a principal bet selector and an ante bet selector 3 (e.g., buttons, or touch-screen regions, or the like). The device 4 may house or be in communication with, e.g., in network connection with, a computer processor 5 in communication with the display and the player input interface 2. The processor 5 may be configured to store in a memory data and/or instructions (e.g., data descriptive of at least one standard deck of playing cards), and to execute software or other processes necessary to perform the method and game embodiments described herein (e.g., dealing at least two but no more than three cards to a first hand and at least two but no more than three cards to a second hand, etc.). The computer processor 5 also may be configured to execute software or other processes that allow the device to accept a wager from a player on either (i) the first hand having a score closer or equal to a predetermined high value than the second hand, (ii) the second hand having a score closer or equal to the predetermined high value than the first hand, or (iii) the first and second hands having the same score.

In another embodiment, the computer processor 5 may also be configured to execute software or other processes that permit a player to place an ante bet with a wager on the first hand having a score closer or equal to the predetermined high value than the second hand, collect the ante bet from the player if the score of the first hand does not equal the score of the second hand, and pay the player an ante bet payoff if the score of the first hand equals the score of the second hand. The computer processor 5 may be programmed to allow a player to choose to be a commission or non-commission player. If a player chooses to be a commission player, the processor may be programmed to collect a commission from each commission player when the commission player places a wager on the first hand and the score of the first hand is greater than the score of the second hand.

Players may find a modified version of Baccarat according to the described embodiments more enjoyable than traditional Baccarat because the player is able to make an additional wager instead of paying a commission. This may give players a greater sense of control over their money. Players may also enjoy better odds on a Tie hand than in traditional Baccarat. Casino and other operators may also welcome this new form of Baccarat because it eliminates the loss of revenue from unpaid commissions.

Although illustrative embodiments have been shown and described herein in detail, it should be noted and will be appreciated by those skilled in the art that there may be numerous variations and other embodiments that may be equivalent to those explicitly shown and described. For example, the scope of the present invention is not necessarily limited in all cases to execution of the aforementioned steps in the order discussed. Unless otherwise specifically stated, terms and expressions have been used herein as terms of description, not of limitation. Accordingly, the invention is not to be limited by the specific illustrated and described embodiments (or the terms or expressions used to describe them) but only by the scope of claims.

I claim:

1. A method of playing a game using a device, wherein the game has predetermined rules using at least one standard deck of 52 actual or virtual playing cards, wherein at least two but no more than three cards are dealt to a first hand, at least two but no more than three cards are dealt to a second hand, and a player wagers on either (i) the first hand having a score closer or equal to a predetermined high value than the second hand, (ii) the second hand having a score closer or equal to the predetermined high value than the first hand, or (iii) the first and second hands having the same score, wherein the predetermined rules make the odds of the first hand having a score closer or equal to the predetermined high value more likely than the second hand having a score closer or equal to the predetermined high value, the method comprising:

providing a display;

providing a player input interface comprising a principal bet selector and an ante bet selector; and providing a computer processor in communication with the display and the player input interface, wherein the processor is configured to:

store data representing at least one standard deck of virtual playing cards and deal at least two but no more than three cards to a first hand, and at least two but no more than three cards to a second hand;

permit a player to place a principal wager on either (i) the first hand having a score closer or equal to a predetermined high value than the second hand, (ii) the second hand having a score closer or equal to the predetermined high value than the first hand, or (iii) the first and second hands having the same score;

permit a player to place an ante bet with a wager on the first hand having a score closer or equal to the predetermined high value than the second hand;

collect the ante bet from the player if the score of the first hand does not equal the score of the second hand; and pay the player an ante bet payoff if the score of the first hand equals the score of the second hand.

2. The method of claim 1, wherein said computer processor is further configured to allow a player to select an option to be a commission player and to collect a commission from each commission player when the commission player places a wager on the first hand and the score of the first hand is greater than the score of the second hand.

3. The method of claim 1, wherein the computer processor is further configured to calculate the ante bet payoff as a multiple of the ante bet or from a flexible pay table.

4. The method of claim 1, wherein the computer processor is further configured to pay the player at a rate of 10-for-1 odds for a wager that the first and second hands will have the same score if the score of the second hand equals the score of the first hand.

5. The method of claim 4, wherein the ante bet is at least 5% of the wager on the first hand.

6. The method of claim 4, wherein the ante bet is at least 10% of the wager on the first hand.

7. The method of claim 5, wherein the ante bet payoff is at a rate of 9-for-2 odds.

8. The method of claim 7, wherein no commission is charged.

9. The method of claim 6, wherein the ante bet payoff at a rate of 8-for-1 odds.

10. The method of claim 9, wherein no commission is charged.

* * * * *